US007001236B2

(12) United States Patent
Blake, Jr.

(10) Patent No.: US 7,001,236 B2
(45) Date of Patent: Feb. 21, 2006

(54) DYNAMIC FIN SYSTEM FOR WATERCRAFT

(76) Inventor: David T. Blake, Jr., 3818 Pachaco St., San Francisco, CA (US) 94116

( * ) Notice: Subject to any disclaimer, the term of this patent is extended or adjusted under 35 U.S.C. 154(b) by 0 days.

(21) Appl. No.: 11/020,736

(22) Filed: Dec. 22, 2004

(65) Prior Publication Data

US 2005/0211423 A1 Sep. 29, 2005

Related U.S. Application Data

(60) Provisional application No. 60/532,200, filed on Dec. 23, 2003.

(51) Int. Cl.
*B63B 1/00* (2006.01)

(52) U.S. Cl. ..... 441/79; 114/152

(58) Field of Classification Search ..... 441/74, 441/79; 114/140, 152
See application file for complete search history.

(56) References Cited

U.S. PATENT DOCUMENTS 4,733,496 A 3/1988 Wallner
4,854,904 A * 8/1989 Wahl ..... 441/79
5,070,804 A 12/1991 Strazzeri
5,649,846 A 7/1997 Harper et al.
6,053,789 A 4/2000 Miyashiro
6,213,044 B1 * 4/2001 Rodgers et al. ..... 114/152
6,439,940 B1 8/2002 Pouchkarev

* cited by examiner

*Primary Examiner*—Lars A. Olson
(74) *Attorney, Agent, or Firm*—Courtney Staniford & Gregory LLP

(57) ABSTRACT

A dynamic fin system (DFS) achieves fin rotation passively via water flow so that no direct active control of fin rotation is required by the watercraft operator. The DFS, using a combination of fin rotation via at least one axle and resistive forces applied to a fin mounting tab, provides an assembly in which a fin can pivot from side to side in a reliable, effective and simple way. The DFS provides ease in turning and stability at a neutral position while minimizing the amount of flow resistance. The DFS provides a strong fin mounting, and uses a combination of an axle for rotational control, a resistive centering force, and a force preload for stabilizing the fin in the neutral position. The DFS provides a mount for a rotating fin in a watercraft hull that supports repositioning of the rotating fin axis both forward and rearward in the hull.

14 Claims, 6 Drawing Sheets

FIGURE 2A
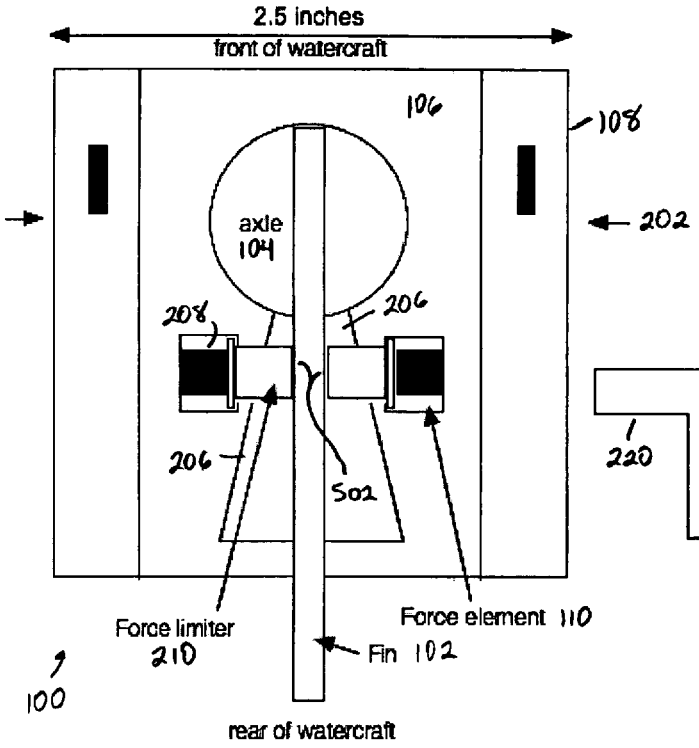
FIGURE 2B
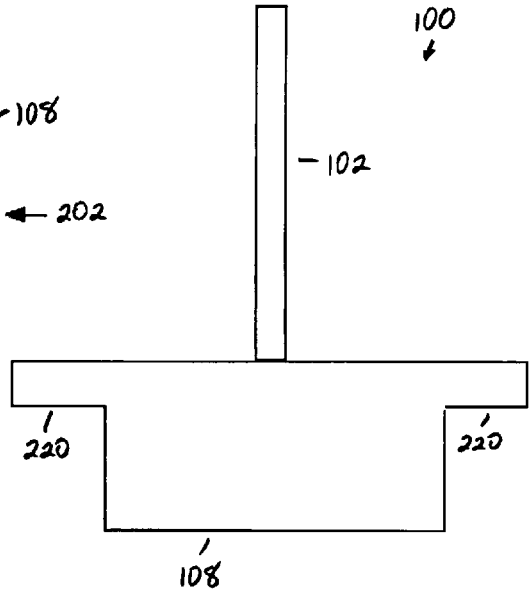
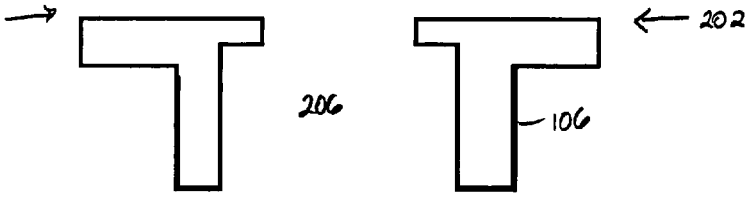
FIGURE 2C

FIGURE 3
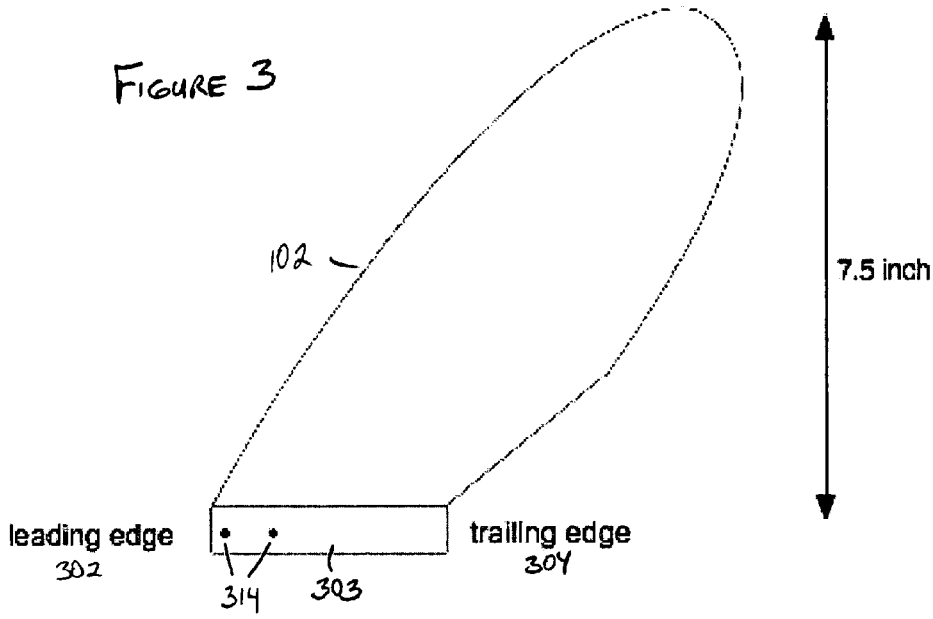
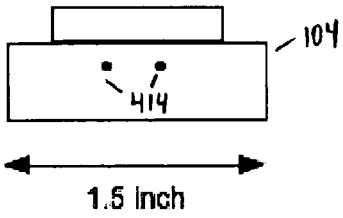
FIGURE 4A
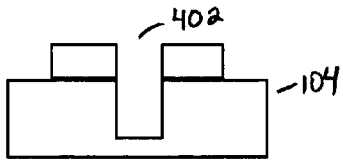
FIGURE 4B
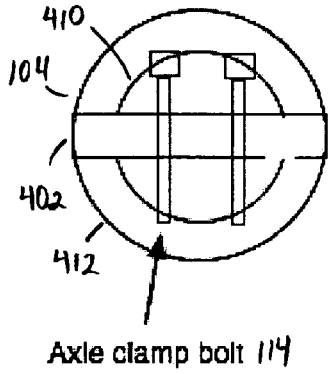
FIGURE 4C

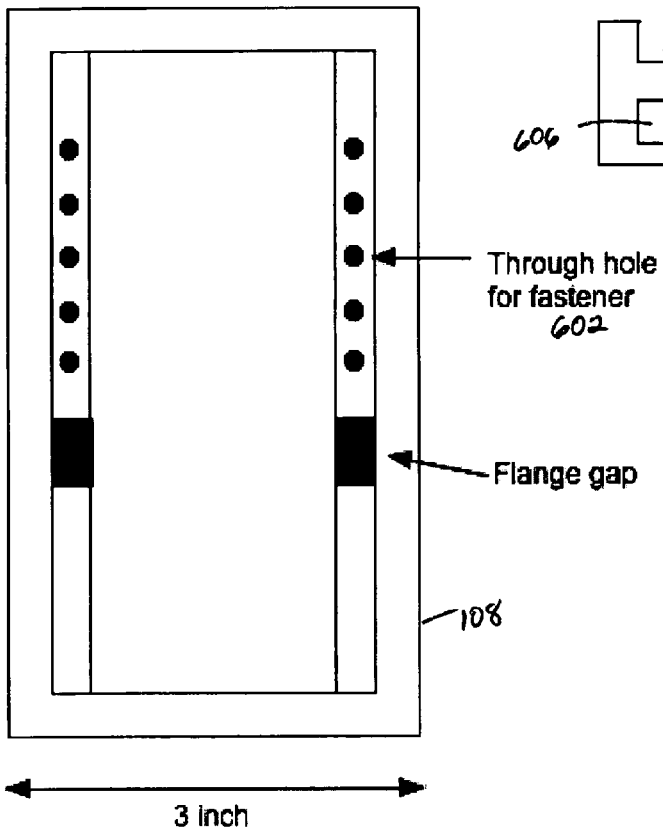
FIGURE 6A
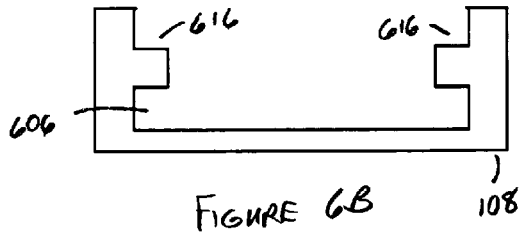
FIGURE 6B
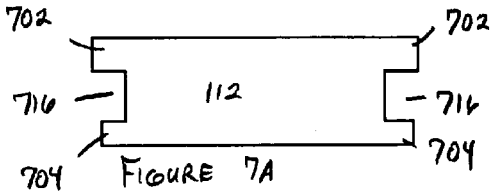
FIGURE 7A
FIGURE 7B
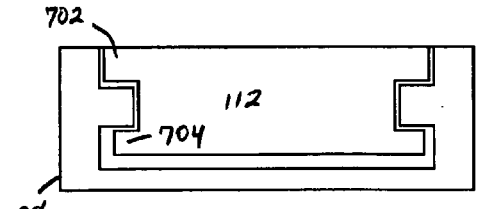
FIGURE 8
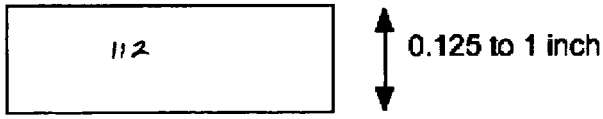

DYNAMIC FIN SYSTEM FOR WATERCRAFT

RELATED APPLICATION

This application claims the benefit of U.S. patent application Ser. No. 60/532,200, filed on Dec. 23, 2003.

TECHNICAL FIELD

The disclosed embodiments relate to systems and methods for a dynamic fin system for numerous watercraft or vessels.

BACKGROUND

Watercraft fin systems come in many flavors. For example, the most common surfboard fin systems have three fins that include two side fins and a central or rear fin.

The two side fins are angled, and the central fin is aligned with the board centerline. The angle of the side fins aids in turning. However, the three fins create increased resistance to water flow by having different angles. If the three fins are aligned, turning is difficult; turning is also more difficult with a single fixed fin. A common attempt to solve this problem is to provide a fin that turns to align with the water flow.

One attempted solution to this problem is found in U.S. Pat. No. 4,733,496, which describes a double fin system that includes a leading blade fixed to the surfboard. A rear half of the fin system is attached to the fixed blade by two pivot pins. Additionally, this system includes a spring-loaded pin for centering the rear half of the fin system relative to the front half. This provides a limited solution to the problem. Much of the force of a surfboard fin is concentrated along the leading edge of the fin, and the leading edge of the fin does not rotate.

Another attempted solution to this problem is found in U.S. Pat. No. 4,854,904, which describes a rotating keel system. This rotating keel system mounts the fin, or keel, in a circular axle, and has limits on rotation either through set screws or through a pie-shaped cutout, and it also has a restoring force to center the fin. However, the rotating keel system lacks a stabilizing mechanism. In particular, there is no securing, or pre-load, force that must be overcome to move the fin out of the center position. This becomes a critical feature because if the fin turns to one side, it will move the rider's weight in a direction opposite of the rear of the watercraft. This will turn the watercraft, and shift the rider's weight to the other side of center. The turning of the fin, and the rider's weight, therefore oscillate out of phase at a critical velocity, and the watercraft becomes destabilized as a result.

Another attempted solution to this problem is found in U.S. Pat. No. 5,070,804, which describes a rotating fin system. The fin of this rotating system is mounted around an axle, and fin rotation is controlled by two force elements that bear on a second shaft perpendicular to the axle. Oscillations are controlled by having the second shaft move over a set of teeth. While this mechanism may provide some amount of frictional dampening, performance will be quantal in rotation, so that the fin will tend to jump from tooth to tooth. Any frictional dampening provided by this system also decreases with wear of the dampening mechanism. Further, there is no pre-load beyond the frictional control of the rotation. Additionally, the use of fin mounted around a narrow axle increases susceptibility to wear and contamination.

Yet another attempted solution to this problem is found in U.S. Pat. No. 6,053,789, which describes a single fin mechanism in which a fin is mounted to a shaft that runs through upper and lower bearing plates that are bearing coupled. The fin rotation of this system however is not resisted by force. Although this system describes a pivoting fin with end limits on rotation, it is not force controlled within those limits, nor is there centering preload. In addition, the fin is mounted around a narrow central axle, so susceptibility to wear and contamination is high.

Likewise, U.S. Pat. No. 6,439,940 describes a fin and watercraft system in which a pair of fins rotate, and the mechanism by which rotation is achieved is a bearing plate. But, like U.S. Pat. No. 6,053,789, this system lacks a central restoring force, or preload. Consequently, what is needed is a fin system for watercraft that allows a fin to rotate around a fixed axis and makes use of resistive forces applied to the fin so as to provide an assembly or system in which the fin pivots from side to side in a reliable, effective and simple way.

BRIEF DESCRIPTION OF THE FIGURES

FIG. 2A is a top view of the DFS, under the embodiment of FIG. 1.

FIG. 2B is a side view of the DFS, under the embodiment of FIG. 1.

FIG. 2C is a cross-sectional view of the DFS centered on the axle cavity, under an embodiment.

FIG. 3 is a side view of the fin of the DFS, under an embodiment.

FIG. 4A is a view of a first side of the axle of the DFS, under an embodiment.

FIG. 4B is a view of a second side of the axle of the DFS, under an embodiment.

FIG. 4C is a top view of the axle of the DFS, under an embodiment.

FIG. 6A is a top view of the finbox of the DFS, under an embodiment.

FIG. 6B is a cross-sectional view of the finbox, under an embodiment.

FIG. 7A is a side view of a spacer of the DFS, under an embodiment.

FIG. 7B is a top view of the spacer, under an embodiment.

FIG. 8 is a cross-sectional view of the finbox including the spacer, under an embodiment.

DETAILED DESCRIPTION

A dynamic fin system (DFS) is described below that achieves fin rotation passively via the water flow so that there is no direct active control of fin rotation required by the watercraft operator. The DFS, using a unique combination of fin rotation via at least one axle and resistive forces applied to a fin mounting tab, provides an assembly or system in which a fin can pivot from side to side in a reliable, effective and simple way. The DFS provides a balance of ease in turning, stability at a neutral position, and minimizes the amount of flow resistance. The DFS provides a strong fin mounting and, in addition, is the only fin system that uses a combination of an axle for rotational control, a resistive centering force, and a mechanism for stabilizing the fin in the neutral position. In addition, the DFS provides a mount for a rotating fin in a watercraft hull that supports repositioning of the rotating fin axis both forward and rearward in the hull.

The DFS of an embodiment can be used with and/or incorporated onto/into watercraft and watercraft systems including, but not limited to, surfboards having any number/combination of fins per board, including one or more of the dynamic fin system and any number of rigid fins, sailboards having any number/combination of fins per board, and windsurfers having any number/combination of fins per board. Further, the DFS can be used with and/or incorporated onto/into planing watercraft including but not limited to tow-in surfboards, wakeboards, skimboards, skurfers, and other planing watercraft.

In the following description, numerous specific details are introduced to provide a thorough understanding of, and enabling description for, embodiments of the DFS. One skilled in the relevant art, however, will recognize that the DFS can be practiced without one or more of the specific details, or with other components, systems, etc. In other instances, well-known structures or operations are not shown, or are not described in detail, to avoid obscuring aspects of the DFS. Dimensions shown in or describe with reference to the Figures are in inches unless otherwise stated. The dimensions shown in the Figures are provided only as example embodiments, and the embodiments are not to be so limited.

Figure 1:
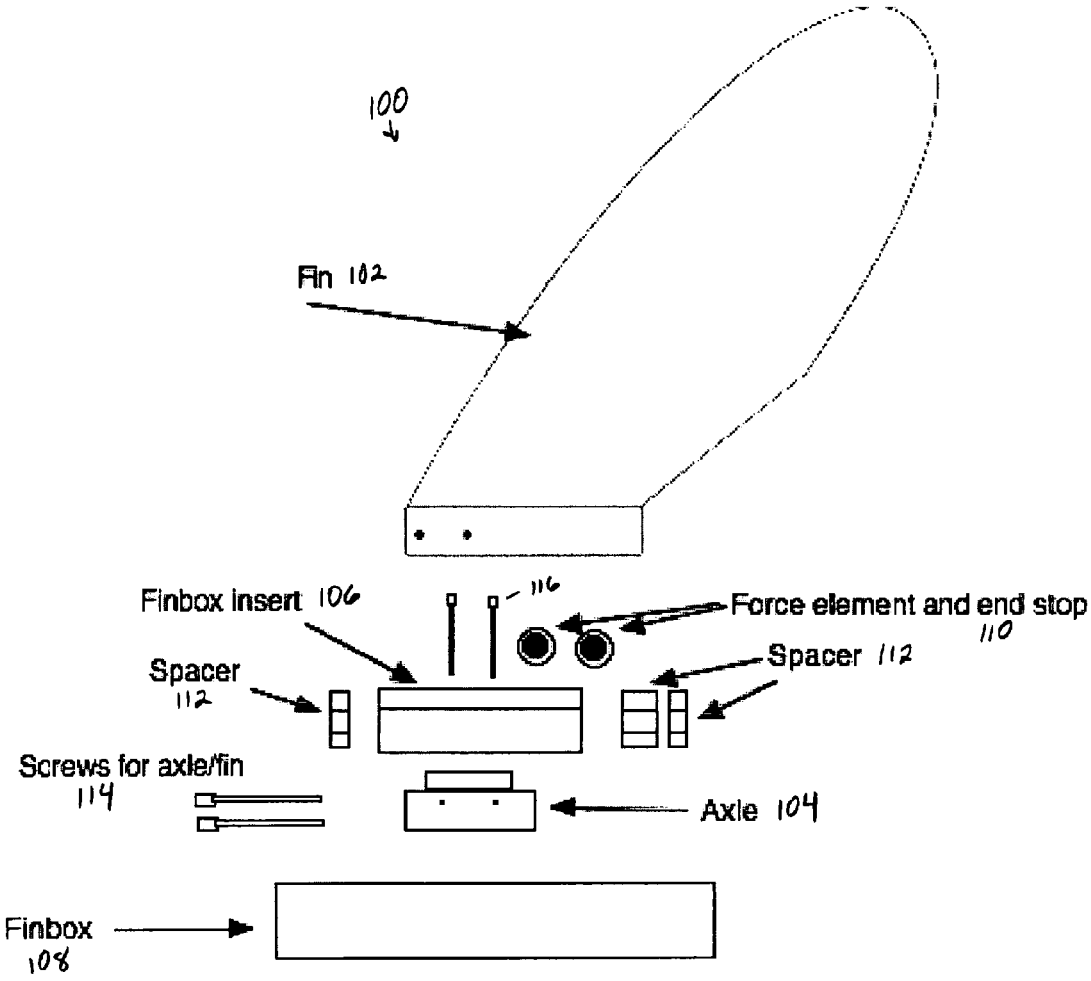
FIG. 1 is an exploded view of a dynamic fin system (DFS), under an embodiment.

FIG. 1 is an exploded view of a dynamic fin system (DFS) 100, under an embodiment. The components of the DFS 100 include but are not limited to a fin 102, an axle 104, a finbox insert 106, a finbox 108 (also referred to as a surfboard box), force elements and end stops 110 (also referred to as "resistive elements 110" and "elastic elements 110"), and spacers 112. The fin of an embodiment is fastened or attached to the axle using screws 114 (also referred to as "axle clamp bolts") inside the finbox insert 106. The force elements and end stops 110 are inserted in the finbox insert 106. The spacers 112 are inserted into the finbox 108, and the finbox insert 106 is inserted into the finbox 108 and fastened with one screw 116 on each side of the fin 102, as described below.

The DFS achieves fin rotation passively via the water flow, with no direct active control of fin rotation by the watercraft operator. The DFS of an embodiment achieves this passive fin control through the combination of fin rotation via the axle, resistive forces applied to the fin mounting tab, and an end-stop to rotation. In addition, the DFS allows the rotational fin assembly (includes the fin 102, axle 104, finbox insert 106, and resistive elements 110) to be positioned at different locations forward and rearward on the host watercraft as described below.

FIG. 2A is a top view of the DFS 100, under the embodiment of FIG. 1. FIG. 2B is a side view of the DFS 100, under the embodiment of FIG. 1. FIG. 2C is a cross-sectional view of the DFS 100 (section 202) centered on the axle (no fin 102 or axle 104 shown), under an embodiment. The finbox insert 106 of an embodiment includes a cavity 206, and the cavity 206 accepts the axle and fin along with the force elements and end stops, where the force elements are positioned inside the cavity in the end stops. The cavity 206 includes a cylindrical portion or segment adjoining at least one shaped region, where the shaped region is shaped as a sector of a circle in which the sides of the shaped region are angled relative to the center line of the finbox insert 106. The cross-section of the finbox insert 106 shows the portion of the cavity 206 that accepts the axle 104. A force limiter 210 couples between an end of the force element 110 and a portion of the fin 102.

FIG. 3 is a side view of the fin 102 of the DFS, under an embodiment. The fin 102 includes a leading edge 302, a trailing edge 304, and a fin mounting tab 303. The fin 102 also includes one or more openings or channels 314 that accept one or more screws (not shown) or other connecting devices that connect the fin 102 and the axle 104 together to form the fin/axle assembly, but is not so limited. The channels 314 are formed in the fin mounting tab 303 of an embodiment, but alternative embodiments may have the channels 314 in other portions of the fin 102.

FIG. 4A is a view of a first side of the axle 104 of the DFS, under an embodiment. The axle 104 includes one or more channels 414 that accept one or more connecting devices (not shown) that anchor the fin 102 and the axle 104 together to form the fin/axle assembly, but is not so limited.

FIG. 4B is a view of a second side of the axle 104, under an embodiment. The axle includes at least one slot 402 configured to accept the fin 102. As an example, the slot 402 accepts the fin mounting tab 303 when attaching the fin 102 and the axle 104 to form the fin/axle assembly.

FIG. 4C is a top view of the axle 104, under an embodiment. The axle 104 may have two outer circumferences 410 and 412 to allow the axle 104 to be secured below the top of the finbox insert 106, but the axle 104 of alternative embodiments may have any number of outer circumferences. The axle 104 accepts any number of screws 114 or other attaching devices for use in attaching the fin 102 to the axle 104 to form the fin/axle assembly. The axle 104 comprises at least one of plastic, low friction plastic, nylon, Teflon®, and plastic impregnated with at least one material like Teflon® (Delrin® acetal resin, for example), but may comprise any type and/or combination of materials.

Figure 5:
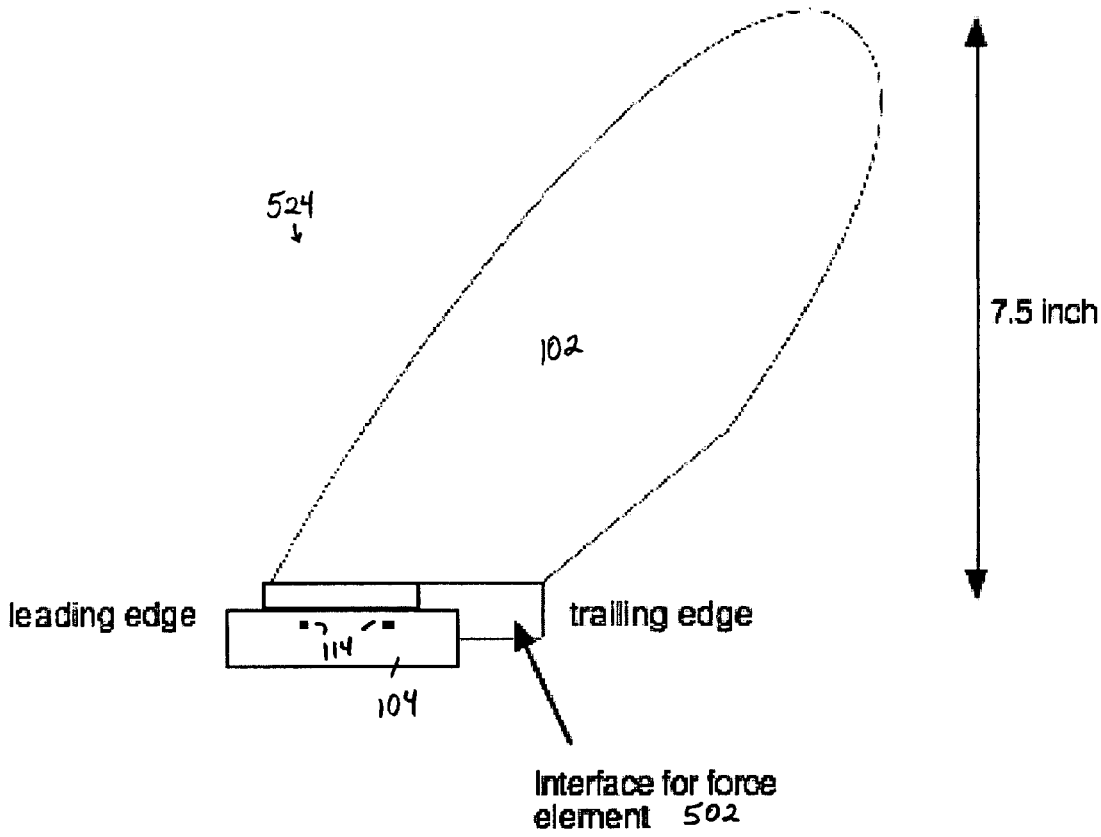
FIG. 5 is a side view of a fin/axle assembly of the DFS, under the embodiment of FIGS. 3 and 4.

FIG. 5 is a side view of a fin/axle assembly 524 of the DFS, under the embodiment of FIGS. 3 and 4. The fin/axle assembly 524 includes the fin 102 as coupled or anchored to the axle 104 using screws 114, for example. The fin 102 of an embodiment forms a fin flange 502 that extends rearward from the axle 104 when the fin 102 is assembled in the axle 104. The fin flange 502 provides a surface that contacts the force elements during operation of the DFS. Portions of the fin mounting tab 303 form the fin flange 502 of an embodiment, however alternative embodiments may form the fin flange 502 from any other portion of the fin 102. As described above with reference to FIG. 2A, a force limiter 210 couples between an end of each force element 110 and a portion of at least one of the fin 102 and the axle 104. For example, the combination of the force elements 110 and the force limiters 210 contact the fin flange 502 portion of the fin 102, where the fin flange 502 extends rearward from the fin 102. Alternative embodiments may provide a flange extending forward and/or rearward from one or both of the fin 102 and the axle 104.

FIG. 6A is a top view of the finbox 108 of the DFS, under an embodiment. FIG. 6B is a cross-sectional view of the finbox 108, under an embodiment. FIG. 7A is a side view of a spacer 112 of the DFS, under an embodiment. FIG. 7B is a top view of the spacer 112, under an embodiment. FIG. 8 is a cross-sectional view of the finbox 108 including the spacer 112, under an embodiment. The finbox 108 includes a flange having one or more holes 602 that accept fasteners for use in fastening the finbox insert 106 to the finbox 108.

The holes 602 of the finbox 108 provide for variable positioning of the DFS in the watercraft via fore-aft positioning of the finbox insert 106 in the finbox 108. One or more spacers 112 may be used with the finbox 108 and finbox insert (not shown) to allow the finbox insert to be reliably fastened at different fore-aft positions within the finbox 108, while leaving the remainder of the top of the finbox 108 planar and without holes.

Figure 10:
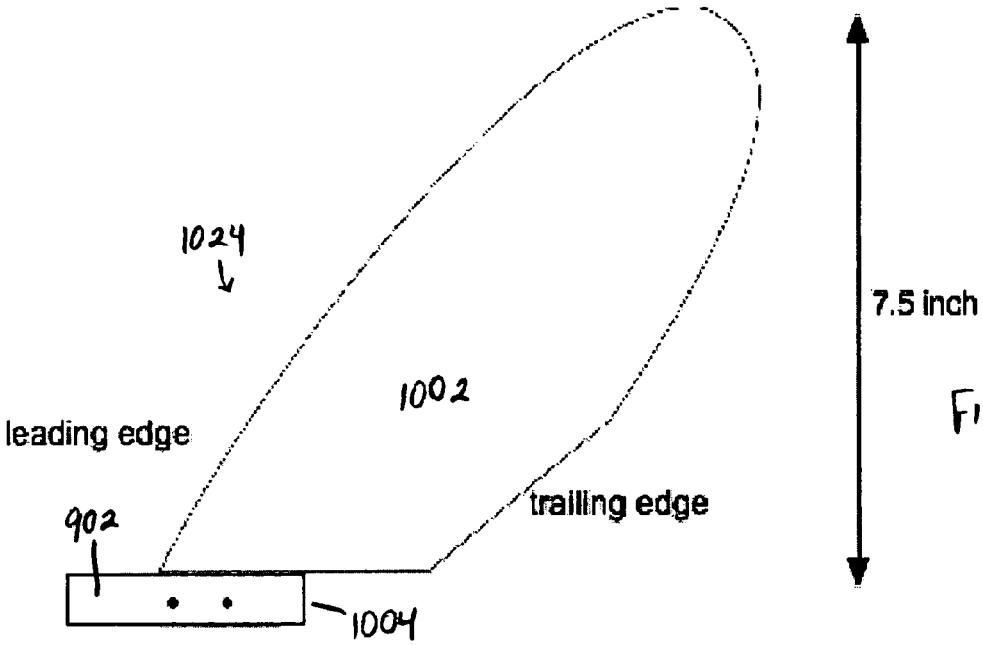
FIG. 10 is a side view of a fin/axle assembly of the DFS, which includes a fin connected to an axle, under the alternative embodiment of FIG. 9.
Figure 9:
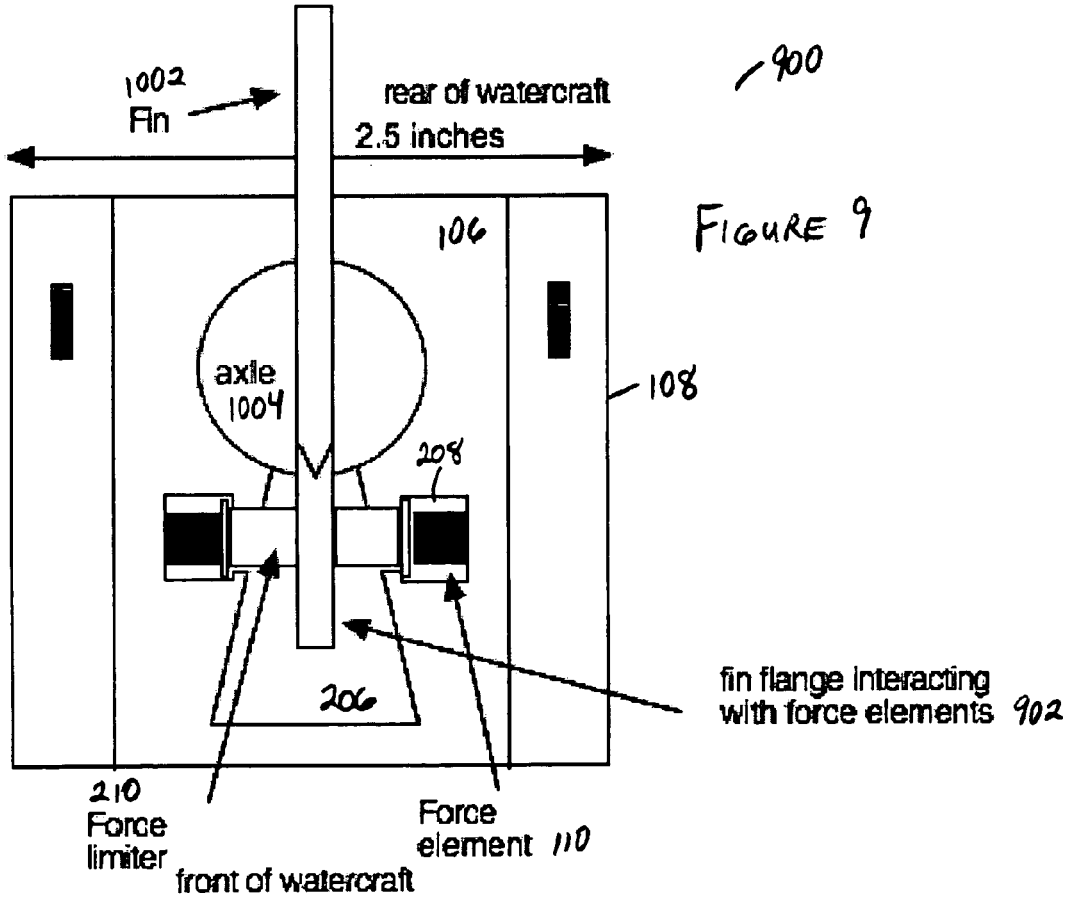
FIG. 9 shows a top view of a DFS, under an alternative embodiment.

FIG. 9 shows a top view of a DFS 900, under an alternative embodiment. FIG. 10 is a side view of a fin/axle assembly 1024 of the DFS 900, which includes a fin 1002 connected to an axle 1004, under the alternative embodiment of FIG. 9. The fin/axle assembly 1024 includes the fin 1002 as coupled or anchored to the axle 1004. The axle 1004 forms a flange 902 that, in contrast to the fin flange 502 (FIG. 5) extends forward to provide a surface that contacts the force elements during operation of the DFS, as described above. Portions of the axle 1004 form the flange 902 of an embodiment, however alternative embodiments may form the flange 902 from any other portion of the fin 1002 and/or axle 1004.

The DFS 900 includes a finbox insert 106 having a cavity 206, and the cavity accepts the axle 1004 and fin 1002 along with the force elements and end stops 110, where the force elements are positioned inside the cavity in the end stops. A force limiter 210 couples between an end of each force element 110 and a portion of the flange 902. For example, the combination of the force elements 110 and the force limiters 210 contact the flange 902 portion of the axle 1004, where the fin flange 902 extends forward from the axle 1004. Alternative embodiments may provide a flange extending forward and/or rearward from one or both of the fin 1002 and the axle 1004.

Referring to FIGS. 1–10, the watercraft fin 102, alternatively referred to as a foil 102, is mounted on the axle 104 of the DFS. The axle 104 allows free rotation within the matching cavity 206 or shell of the finbox insert 106. The main plane of the fin 102 is aligned with the axis of rotation, and the fin 102 protrudes along this axis, and may additionally extend in the fore-aft direction. The fin 102 also has a mounting tab 303, which extends forward and/or rearward from the axle 104 along the central axis of the finbox insert 106 when centered. The mounting tab 303 will contact a portion of the finbox insert 106 to limit its rotation to a fixed number of degrees. Alternatively, the finbox insert 106 may include end-limit pins or single points of contact to limit rotation instead of using the pie-shaped cavity 206. The rotation limit of an embodiment is less than 90 degrees, but is not so limited. The mounting tab 303 also contacts force elements 110 and/or force limiters 210 that include, for example, rubber or polyurethane pieces, or springs. The force elements 110 provide a force resisting the rotation of the fin 102 through their contact with the mounting tab 303.

There are two embodiments of the fin mounting tab 303 for use in mounting the fin 102 to the axle 104. A first embodiment of the mounting tab uses a vertical through-hole in the mounting tab in front of the fin leading edge, and a sideways through-hole approximately in the range of 0.25 to 2 inches behind the vertical hole. A fastener runs through the vertical through-hole and holds the fin 102 in the slot 402 of the axle 104. A second fastener runs sideways through the axle 104 and the sideways through-hole in the fin 102 into the opposing side of the fin 102. The sideways fastener is countersunk into the axle 104 so that no portion of the fastener protrudes from the outer cylinder 412 or radius of the axle 104, but is not so limited. The vertical fastener applies a force that holds the fin 102 vertically in the slot 402 of the axle 104. The sideways fastener applies a force that pushes the two sides of the axle 104 together across the slot 402, effectively sandwiching the fin 102 between the sides of the slot 402.

A second embodiment of the mounting tab 303 and axle 104 includes the use of two sideways fasteners 114, where both fasteners 114 are countersunk so as not to protrude from the outer cylinder 412 of the axle 104, and both apply force to sandwich the fin 102 between the sides of the slot 402. Any number of fasteners may be used, but at least one fastener will protrude across the axle 104 and pull the sides of the axle 104 together to apply force to the side of the fin 102.

An alternative embodiment of the DFS 100 includes a fin tab that is narrower on the top, and broader on the bottom, and is inserted into a matched cavity in the axle. The mounting will prevent the fin from sliding out of the top of the axle.

As described above, the interface between the axle 104 and the finbox insert 106 includes a cylindrical opening or cavity 206 in the finbox insert 106 in which the cylindrical axle 104 sits or rides. The height and width of the axle 104 and the cylindrical cavity 206 is closely matched, and the axle 104 and matching cylindrical cavity 206 can have multiple diameters to prevent the axle 104 from advancing in one axial direction. For example, the diameter of the cylindrical cavity 206 near the outside of the finbox insert 106 may be smaller than the diameter of the cylindrical cavity 206 near the inside of the finbox insert 106, so that the axle 104 may not advance to the outside of the finbox insert 106.

The cavity 206 of the finbox insert 106 of an embodiment also includes a shaped region 206 that accepts the fin mounting tab 303. The shaped region 206 is shaped as a sector of a circle, but is not so limited. The fin mounting tab 303 extends from the axle 104 into the shaped region 206, but is not so limited. The sides of the shaped region 206 are angled relative to the center line of the finbox insert 106. The shaped region 206 of an embodiment limits the rotation of the fin 102 at an angle approximately in the range of zero (0) degrees to 45 degrees, as the axle 104 may no longer rotate once the fin mounting tab 303 contacts sides of the shaped region 206.

The interior of the finbox insert 106 also includes two additional perpendicular cutouts 208 that are perpendicular to the finbox centerline. The perpendicular cutouts 208 are located adjacent the sides of the shaped region 206 and couple to the interior of the shaped region 206. Each of the perpendicular cutouts 208 holds an elastic element 110 that applies a resistive force to the rotation of the fin 102 away from the centerline of the finbox 108. The elastic element 110 of an embodiment includes the force element 110. The elastic elements 110 include at least one of rubber, polyurethane, and metal springs, but are not limited to any one or combination of these materials as other elastic elements contemplated by one skilled in the art can be used. In addition, the elastic elements 110 may be contained within the circumference of the axle 104, provided the elastic elements 110 have a point of contact with the finbox insert 106 to establish a force relation between the axle 104 and the finbox insert 106.

The perpendicular cutouts 208 may additionally have a mechanical protrusion, or narrowing, so that the elastic elements may have end-stops. The net effect is that whereas each elastic element 110 will resist sideward movement of the fin 102, the two elastic elements 110 will not counteract each other. Each elastic element 110 may impact the fin 102 only in one hemifield of rotation. The fin 102 thus remains fixed at some pre-determined position without its range of rotation, and must overcome a preload force on one of the elastic elements 110 before the components of the DFS 100 allow the fin 102 to rotate. The elastic elements preload the fin and/or fin/axle assembly as described above so that a non-zero force that is greater than the preload force may move the fin away from a neutral position.

The finbox insert 106 of an embodiment also includes a tab 220 or flange 220 along at least one portion of the finbox insert 106 outer perimeter, where the tab 220 extends for some distance perpendicular to the finbox centerline. This tab 220 overlaps a matching cutout in the finbox 108 which allows at least one vertical fastener 116 to fasten the finbox insert 106 to the finbox 108. The fastener 116 protrudes through holes in the tab 220 and fastens to mated nuts or threads (not shown) in the finbox 108. The finbox insert 106 comprises at least one of metals including a variety of steels, dense plastic, glass reinforced plastic, cast material, and machined material.

The finbox insert 106 is connected to the finbox 108 by a set of fasteners, for example screws in one embodiment. In front of and/or behind the finbox insert 106 are spacers 112, which serve to cover the portions of the finbox 108 not including the finbox insert 106. This system allows the finbox insert 106 to be attached to the finbox 108 at different positions.

The finbox 108 of an embodiment is a rectangular box, but is not limited to this shape as other shapes are contemplated hereunder. The finbox 108, which is also referred to as a surfboard box 108 when used as a component of a surfboard, includes a large rectangular region 606 that accepts the width of the finbox insert 106. The finbox 108 also includes a rectangular region that accepts the tab 220 of the finbox insert 106, so that when the finbox insert 106 is fastened to the finbox 108, the two approximate the outer circumference of a box. The finbox 108 comprises at least one of materials including a variety of steels, plastic, glass reinforced plastic, cast plastic or metal or other materials, and machined material.

The finbox 108 also includes a mechanism by which the spacers 112 are held in place without additional fasteners. In an embodiment, the portion of the finbox 108 underneath the region that accepts the finbox insert tabs 220 includes at least one rail 616. The rail 616 protrudes or connects to one or more side walls of the interior of the finbox 108. The rail 616 is oriented in the plane of the finbox 108, and extends from front to back along the length of the finbox 108.

The spacers 112 of an embodiment have a width approximately equal to the width of the finbox insert 106 plus the tab 220, and have side cutouts 716 or slots 716 that allow the spacers 112 to fit over the finbox rail 616. Each spacer 112 includes a first flange 702 on at least one outside surface, a slot 716 below the flange 702, and a second flange 704 below the slot 716, where each flange 702/704 extends forward and rearward. The spacers 112 each have a first 702 and second 704 flange along with a slot 716 on each end, but alternative embodiments may include flanges 702/704 and the slot 716 only on one end of the spacer 112, or only on one end of some of the spacers 112 included in the DFS 100.

The spacers 112 fill the volume in the finbox 108 not occupied by the finbox insert 106, but are not so limited. When assembling the DFS of an embodiment, the spacers 112 are inserted followed by placement of the finbox insert 106 in the finbox 108, and the fasteners are subsequently tightened.

The finbox 108 mounts to the planing watercraft, in an embodiment, by being glued or otherwise attached into a recess in the bottom, water-facing, side of the planing watercraft. This positions the top of the finbox 108 therefore, as described in the embodiments herein, at the bottom surface of the planing watercraft. The result of this mounting is that the only portion of the DFS 100 that protrudes from the bottom of the watercraft into the water flow is the fin 102.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import, when used in this application, refer to this application as a whole and not to any particular portions of this application. When the word "or" is used in reference to a list of two or more items, that word covers all of the following interpretations of the word: any of the items in the list, all of the items in the list and any combination of the items in the list.

The above description of illustrated embodiments of the DFS is not intended to be exhaustive or to limit the system to the precise form disclosed. While specific embodiments of, and examples for, the DFS are described herein for illustrative purposes, various equivalent modifications are possible within the scope of the system, as those skilled in the relevant art will recognize. The teachings of the DFS provided herein can be applied to other vehicle systems, not only for the systems described above.

The elements and acts of the various embodiments described above can be combined to provide further embodiments. These and other changes can be made to the DFS in light of the above detailed description.

All of the above references and United States patents are incorporated herein by reference. Aspects of the DFS can be modified, if necessary, to employ the systems, functions and concepts of the various patents and applications described above to provide yet further embodiments of the system.

What is claimed is:

1. An apparatus comprising:

a housing including a first cavity and a second cavity;

an axle rotatably coupled to the housing, wherein the first cavity receives the axle;

a fin having a mounting tab, wherein the axle connects to the mounting tab and the second cavity receives the mounting tab; and a plurality of force elements coupled to the housing, the force elements contacting the a portion of the mounting tab in order to apply force to at least one of the fin and the axle to move at least one of the fin and the axle towards a neutral rotational position, wherein the force elements preload at least one of the fin and the axle so a non-zero force rotates at least one of the fin and the axle away from the neutral position.

2. The apparatus of claim 1, wherein the second cavity comprises sides that are each angled relative to a centerline of the housing, wherein the sides limit rotation of the fin.

3. The apparatus of claim 1, wherein a first region of the axle has a first diameter and a second region of the axle has a second diameter.

4. The apparatus of claim 1, further comprising an end-stop coupled to each of the force elements, wherein the end stops prevent counteracting forces between the force elements.

5. The apparatus of claim 1, further comprising a receptacle that receives the housing in one of a plurality of positions relative to a front side and a rear side of the receptacle.

6. The apparatus of claim 5, further comprising at least one spacer, wherein the spacer couples to the receptacle to fill a void in the receptacle between a housing end and a corresponding receptacle side.

7. The apparatus of claim 1, wherein the housing couples to at least one of a watercraft, a watercraft system, a surfboard, a sailboard, a windsurfer, a tow-in surfboard, a wakeboard, a skimboard, and a skurfer.

8. A system comprising:

a housing, wherein the housing connects to a bottom portion of a watercraft;

an insert including a first cavity and a second cavity, wherein the insert couples to the housing in one of a plurality of positions relative to a rear area of the watercraft;

an axle rotatably coupled to the first cavity;

a fin connected to the axle; and a plurality of force elements coupled to the insert, the force elements contacting a portion of a flange that is a component of at least one of the fin and the axle, wherein the second cavity receives the flange, wherein the force elements apply force to an assembly including the axle and the fin to move the assembly towards a neutral rotational position, wherein the force elements preload the assembly so a non-zero force rotates the assembly away from the neutral rotational position.

9. The system of claim 8, further comprising an end-stop coupled to each of the force elements, wherein the end stops prevent counteracting forces between opposing force elements.

10. The system of claim 8, further comprising at least one spacer that couples between the housing and the insert to fill a space between an end of the housing and a corresponding end of the insert.

11. The system of claim 8, wherein the second cavity comprises sides that are each angled relative to a centerline of the housing, wherein the sides limit rotation of the fin.

12. The system of claim 8, wherein a first region of the axle has a first diameter and a second region of the axle has a second diameter.

13. The system of claim 8, wherein the housing couples to at least one of a surfboard, a sailboard, a windsurfer, a tow-in surfboard, a wakeboard, a skimboard, and a skurfer.

14. A system comprising:

an insert that couples to a housing in one of a plurality of positions relative to a rear area of a watercraft, the insert including a first cavity and a second cavity;

a stabilizing device rotatably coupled to the first cavity, the stabilizing device including at least one of a fin and a flange; and a plurality of force elements coupled to at least one of the insert and the housing, the force elements contacting a portion of the flange, wherein the force elements apply force to the flange resistive to rotation of the stabilizing device to move the stabilizing device towards a neutral rotational position, wherein the force elements preload the stabilizing device so a non-zero force rotates the stabilizing device away from the neutral rotational position.

* * * * *